US005878838A

United States Patent [19]

Lapp

[11] Patent Number: 5,878,838

[45] Date of Patent: Mar. 9, 1999

[54] SCAFFOLD STRUCTURE

[76] Inventor: Levi S. Lapp, 245 Hill Rd., New Holland, Pa. 17557

[21] Appl. No.: 796,795

[22] Filed: Feb. 6, 1997

[51] Int. Cl.[6] ..... E04G 3/10

[52] U.S. Cl. ..... 182/150; 182/82; 182/113

[58] Field of Search ..... 182/82, 102, 113, 182/119, 150, 222; 248/235; 256/69

[56] References Cited

U.S. PATENT DOCUMENTS

| | | | |
|---|---|---|---|
| 2,805,902 | 9/1957 | Drasek et al. | 182/82 |
| 2,833,503 | 5/1958 | Harshbarger et al. | 248/235 |
| 2,882,101 | 4/1959 | Michalak et al. | 182/82 |
| 2,957,670 | 10/1960 | Wendl et al. | 248/216.4 |
| 5,503,358 | 4/1996 | Lapp | 248/235 |

*Primary Examiner*—Daniel P. Stodola
*Assistant Examiner*—Hugh B. Thompson

[57] ABSTRACT

A scaffold structure having a guard rail system for preventing falls from the scaffolding, and having adjustable stops for adjustably positioning plank members upon the scaffold structure. The guard rail system includes guard rail posts removably secured to a platform member of the scaffolding by inserting a peg into a fixed stop on the platform member, spacing bars for bracing the guard rail posts, and a guard rail supported by the posts. The platform member includes a center channel, and stop members disposed within the channel which are adjustably positioned along the channel. The stop members are disposed on both sides of the planks to maintain the planks in position.

20 Claims, 3 Drawing Sheets

30
10
16
33
18
36
37
20
12
31
14

20
18
12
16

13
32
35
14

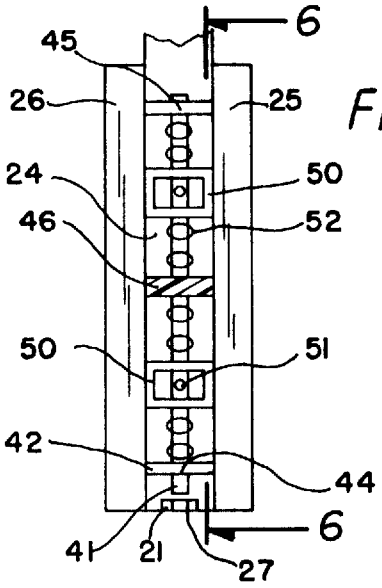
FIG.5
FIG.6
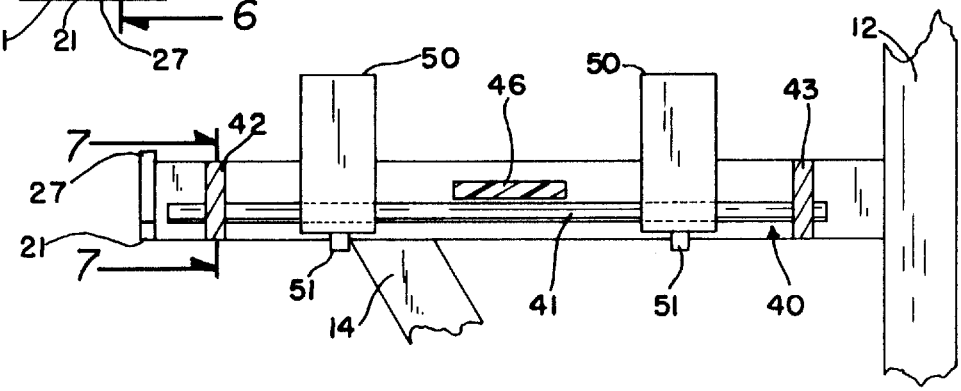
FIG.7
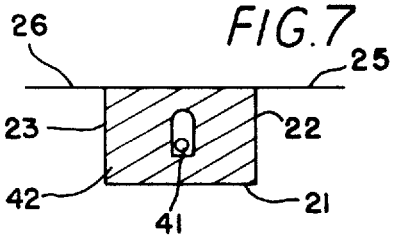
FIG.8
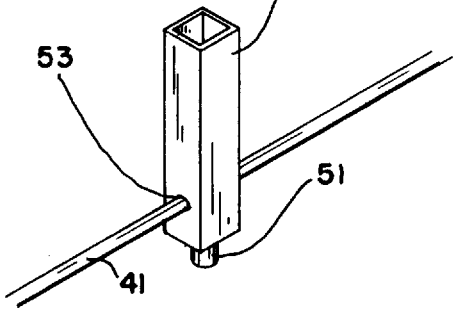

SCAFFOLD STRUCTURE

BACKGROUND OF THE INVENTION

1. Field of the Invention

The present invention relates t o scaffolding and more particularly pertains to a new scaffold structure having a guard rail system removably attached thereto and an adjustable stop system for adjustably positioning plank members upon the scaffold structure.

2. Description of the Prior Art

The use of scaffolding is known in the prior art. More specifically, scaffolding heretofore devised and utilized are known to consist basically of familiar, expected and obvious structural configurations, notwithstanding the myriad of designs encompassed by the crowded prior art which have been developed for the fulfillment of countless objectives and requirements.

For example, U.S. Pat. No. 5,503,358 to Lapp discloses a suspended wall scaffold structure. The structure includes a platform member having a center channel. Planks are supported by the platform member and held in position by either retaining pins on the platform member or pivoting retainer members disposed within the channel. Although the pins are adjustable, they are not adjustable within the channel, while the pivoting retainer members are not adjustable along the channel. In addition, this scaffold structure does not include a guard rail system attached thereto, for preventing falls from the scaffold structure.

While these devices fulfill their respective, particular objectives and requirements, the aforementioned patents do not disclose a scaffold structure having both a guard rail system and adjustable stops. The inventive device includes guard rail posts removably attached to platform members of the scaffolding, a guard rail supported by the guard rail posts, horizontally extending spacing bars connected to the guard rail posts, and stop members disposed within a channel of the platform members which are adjustably positioned along the channel.

In these respects, the scaffold structure according to the present invention substantially departs from the conventional concepts and designs of the prior art, and in so doing provides an apparatus primarily developed for the purpose of preventing falls from the scaffolding and adjustably positioning plank members upon the scaffold structure.

SUMMARY OF THE INVENTION

In view of the foregoing disadvantages inherent in the known types of scaffolding now present in the prior art, the present invention provides a scaffold structure construction wherein the same can be utilized for preventing falls from the scaffolding, and for adjustably positioning plank members upon the scaffolding.

The general purpose of the present invention, which will be described subsequently in greater detail, is to provide a scaffold structure apparatus and method which has many of the advantages of the scaffolding mentioned heretofore and many novel features that result in a scaffold structure which is not anticipated, rendered obvious, suggested, or even implied by any of the prior art scaffolding, either alone or in any combination thereof.

To attain this, the present invention generally comprises a scaffold structure having a guard rail system removably attached thereto, and having a platform member with a center channel, and stop members disposed within the channel which are adjustably positioned along the channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a scaffold structure apparatus and method which has many of the advantages of the scaffolding mentioned heretofore and many novel features that result in a scaffold structure which is not anticipated, rendered obvious, suggested, or even implied by any of the prior art scaffolding, either alone or in any combination thereof.

It is another object of the present invention to provide a scaffold structure which may be easily and efficiently manufactured and marketed.

It is a further object of the present invention to provide a scaffold structure which is of a durable and reliable construction.

An even further object of the present invention is to provide a scaffold structure which is susceptible of a low cost of manufacture with regard to both materials and labor, and which accordingly is then susceptible of low prices of sale to the consuming public, thereby making such scaffold structure economically available to the buying public.

Still yet another object of the present invention is to provide a scaffold structure which provides in the apparatuses and methods of the prior art some of the advantages thereof, while simultaneously overcoming some of the disadvantages normally associated therewith.

Still another object of the present invention is to provide a scaffold structure for preventing falls from the structure, and for adjustably positioning plank members upon the scaffold structure.

Another object of the present invention is to provide a scaffold structure having a guard rail removably attached to the scaffold for preventing falls.

Yet another object of the present invention is to provide a scaffold structure having an adjustable stop system, the scaffold structure including a platform member with a center channel, and stop members disposed within the channel which are adjustably positioned along the channel.

Still yet another object of the present invention is to provide a scaffold structure that facilitates the positioning of planks upon the scaffold structure.

Even still another object of the present invention is to provide a scaffold structure that prevents stops from being lost or misplaced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a top view of the platform member taken along line 5—5 of FIG. 3.

FIG. 6 is a cross sectional view of the platform member taken along line 6—6 of FIG. 5.

FIG. 7 is a cross sectional view taken along line 7—7 of FIG. 6.

FIG. 8 is a perspective view of one stop member, showing the disposed through the stop member.

DESCRIPTION OF THE PREFERRED EMBODIMENT

Figure 1:
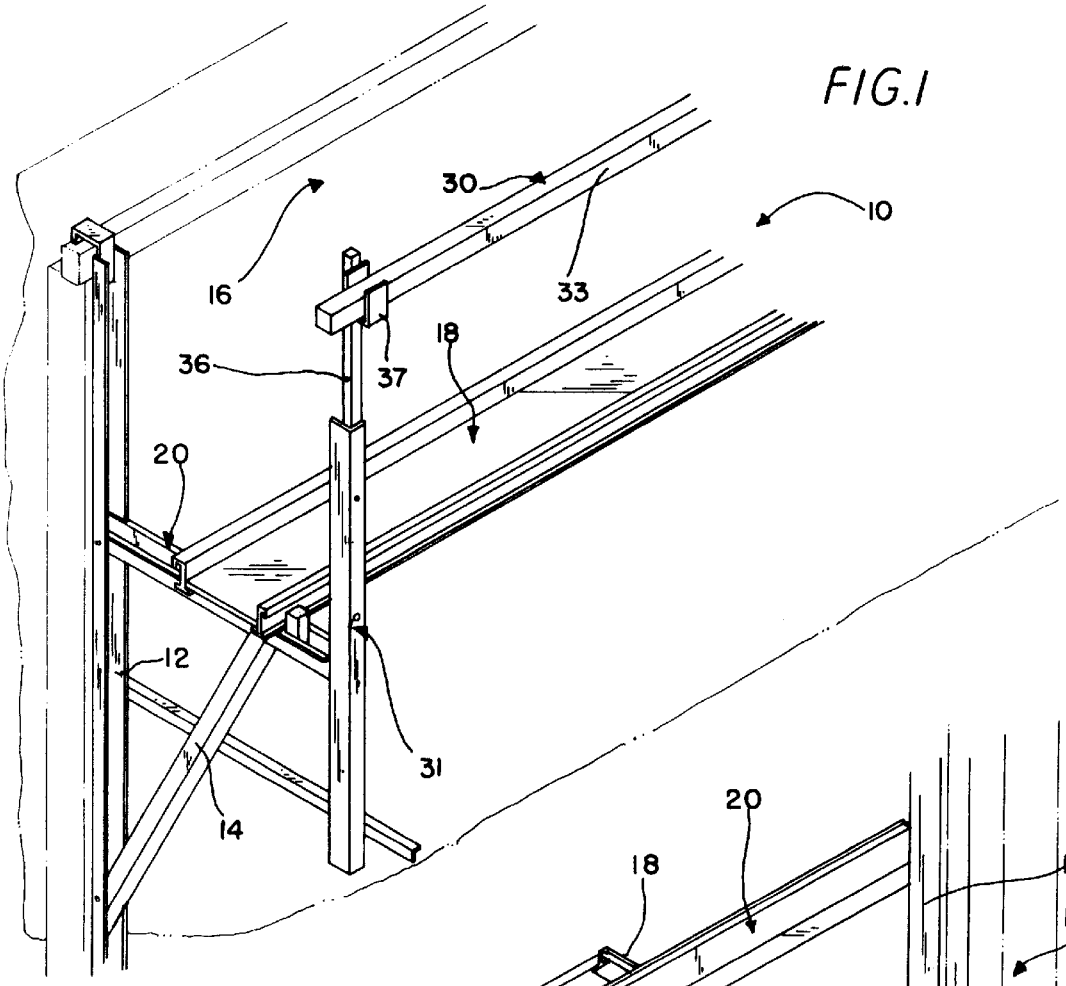
FIG. 1 is an isometric illustration of a scaffold structure incorporating a guard rail system according to the present invention.

With reference now to the drawings, and in particular to FIGS. 1 through 8 thereof, a scaffold structure embodying the principles and concepts of the present invention and generally designated by the reference numeral 10 will be described.

This invention forms an improvement over U.S. Pat. No. 5,503,358, the disclosure of which is hereby incorporated by reference. More specifically, it will be noted that the scaffold structure 10 comprises a main support member 12, a platform member 20, and a brace member 14 extending between the main support member and the platform member.

Figure 2:
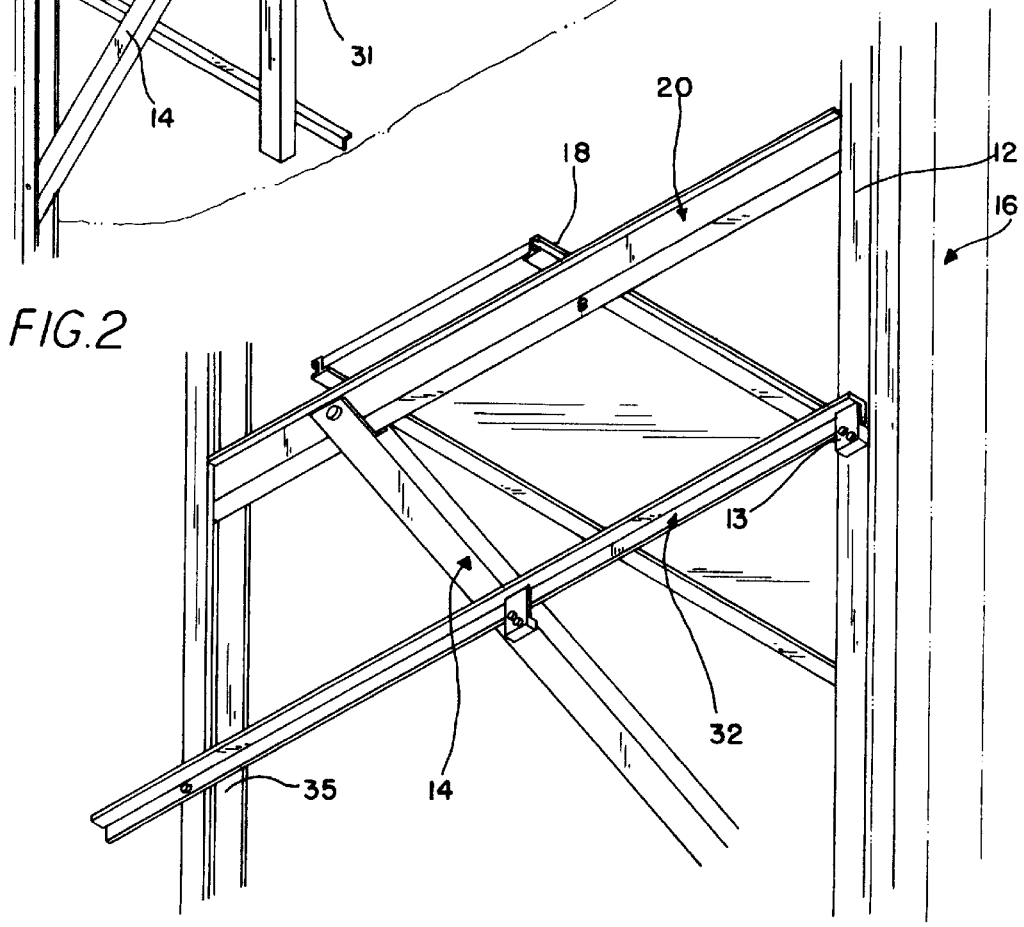
FIG. 2 is a further isometric illustration of the scaffold structure.

As described in the above referenced patent, and as best shown in FIGS. 1–2 herein, the main support post 12 is secured to a wall 16 so that it extends generally vertically. Platform member 20 is connected to the main support post 12 so as to extend perpendicularly to the post 12. Brace member 14 is connected between the post 12 and the platform member 20, in order to support the platform member is position. At least a pair of such assemblies is preferably used to support wooden planks 18, or the like, on the platform members 20. The planks 18 thus form a base upon which people or materials can be stabily supported.

People or objects which are supported by the scaffolding must be prevented from falling off of the structure. Therefore a guard rail system 30 is provided. The system 30 includes guard rail posts 31 removably attached to the platform members 20 and extending vertically therefrom, spacing bars 32, and a guard rail 33 supported by the guard rail posts 31.

Figure 3:
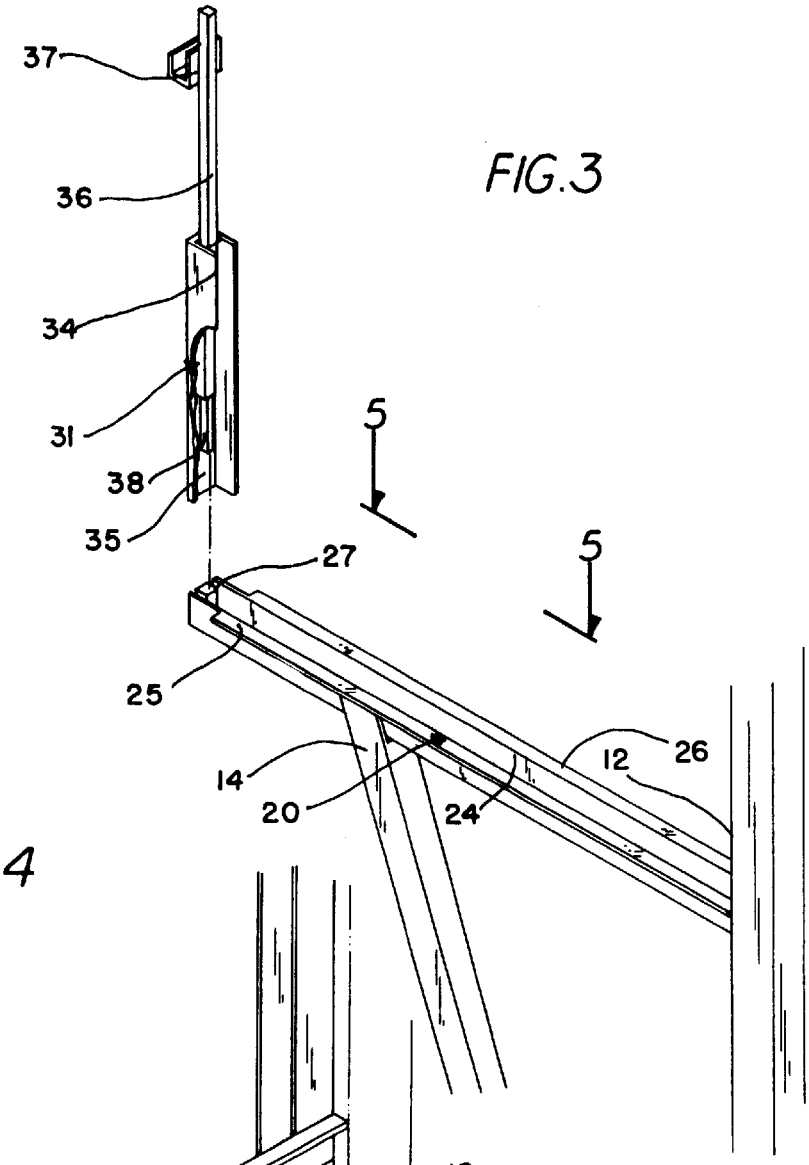
FIG. 3 is an exploded view of a guard rail post and how it attaches to a platform member.

As best shown in FIGS. 2 and 3, each guard rail post 31 includes a main post member 34 which is U-shaped so as to define a U-shaped channel 35. Disposed within the channel 35, and affixed to the main post member 34 in any suitable fashion, is a tubular rail support member 36. The member 36 can be formed from square tubing, for instance. Attached at one end of the member 36, such as by threaded fasteners, is a U-shaped holder 37 which supports the guard rail 33. The other end of the member 36 includes a peg 38, such as a piece of square tubing, which fits within the tubular member 36 and is secured thereto, such as by threaded fasteners. Each guard rail post 31 is thus adapted to be removably attached to the end of the platform member 20 in a manner to be later described.

Figure 4:
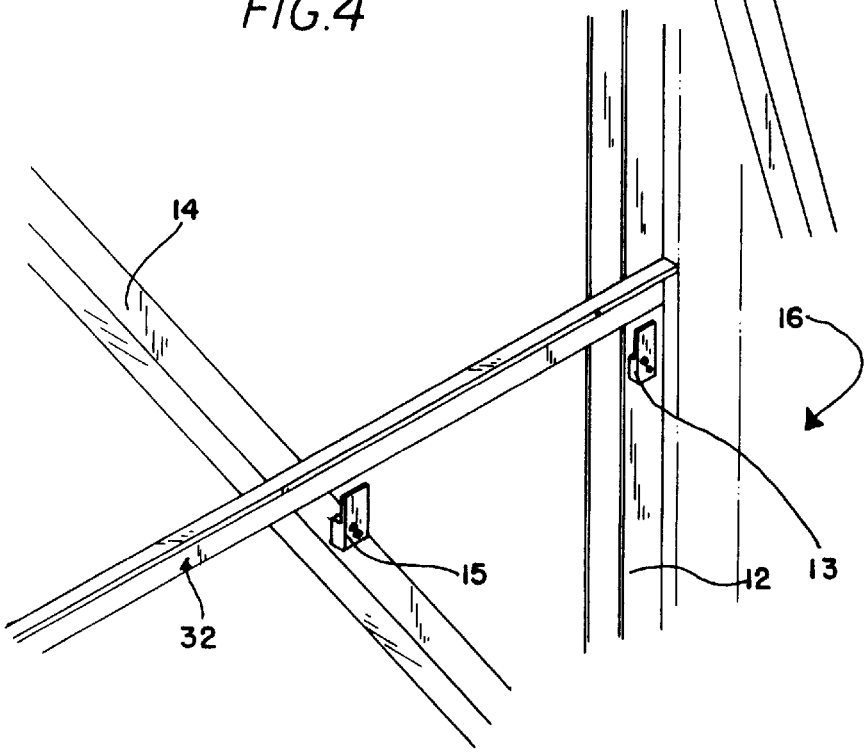
FIG. 4 is a view of a spacing bar and how it connects with the main support member and the brace member.

Each spacing bar 32 is attached adjacent one end thereof to a bottom end of each guard rail post 31 in a conventional manner, such as by bolts. The bar is for instance a length of angle iron. The bar 32 extends substantially horizontally, and connects at its opposite end with the main support member 12. The main support member 12 includes a bracket 13 attached thereto for supporting the end of the bar 32. A bracket 15 is also attached to the brace member 14 for supporting an intermediate portion of the bar 32. Note that each bracket 13, 15 defines a slot between the member 12, 14 and the bracket 13, 15 which slidably receives a portion of the bar 32 therein. Thus, as is best seen in FIG. 4, the bar slidably fits within the slots defined by the brackets 13, 15, but can be easily removed from the slots for facilitating detachment of the guard rail system.

Additionally, the planks must be prevented from shifting along the platform members, and sometimes the position of the planks must be adjusted. Therefore the platform member 20 of the instant invention provides stops 40 which are adjustable along the platform member.

As can be seen in FIGS. 3 and 5–8, the platform member 20 is a generally U-shaped bar having a bottom wall 21 and side walls 22, 23 extending orthogonally from the bottom wall 21. The bottom wall and side walls define a center channel 24 which extends along the member 20. The side walls 22, 23 also include extensions 25, 26 extending therefrom for providing added support for the planks. Tubular stop 27 is disposed within the channel 24 and fixed to the bottom wall 21. The size of the tubular stop 27 is such that it can slidably receive the peg 38 of the guard rail post 31 therein. Thus it should be recognized that the end of the platform member 20 is disposed within the U-shaped channel 35 of post 31, and that the peg 38 fits within the stop 27, thus securely fixing the post 31 to the platform member.

Stops 50 are disposed within the channel 24 and are adjustably supported within the channel by a supporting means 40. The stops 50 are formed of square tubing and extend above the side walls 22, 23 a height generally equal to, or less than, the thickness of the planks 18. The stops include pegs 51 extending from their bottoms, which fit in through holes 52 in the bottom wall 21. The stops can thus be positioned along the channel 24 by lifting the stop until the peg is removed from the hole 52 and then inserting the peg into another hole. The stops additionally include a passage 53 therethrough which allows passage of a rod 41 of the supporting means 40. The passage 53 permits the stop to be slid along the rod to different positions.

The rod 41 of the supporting means 40 is supported within the channel 24 by holding walls 42, 43. The walls 42, 43 close off the channel and extend between the side walls and from the bottom wall. The walls include oval shaped slots 44, 45 through which the rod extends. The slots 44, 45 permit the rod to move up and down within the channel, between the ends of the slots.

A resilient biasing member 46, made of rubber for instance, extends between the side walls and contacts the rod 41 at about the center of the rod. The biasing member 46 applies a downward force on the rod which forces the ends of the rods to the bottom of the slots 44, 45 and thus keeps the stop pegs 51 firmly within the holes 52. However, the member 46 should be resilient enough to allow a person to manually pull a stop and its peg from a hole against the bias force of the member 46, this movement being permitted by the slots 44, 45, and thus slide the stop along the rod 41 to change its position. Once at the desired position, the person releases the stop and the biasing force on the rod forces the stop peg into the hole.

In use, the scaffold structure is assembled and attached to the wall 16. The guard rail system is attached by inserting the pegs 38 of the guard rail posts into the fixed stops 27, securing the spacing bar 32, and placing the guard rail 33 in the holders 37. The planks 18 are then disposed on top of the platform members. The stops 50 are then adjusted to either side of the planks, thus holding the planks in position. If the user decides to shift the position of the planks, the user moves the planks to the new position and adjusts the stops to the new locations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A scaffold structure, comprising:

a generally vertically extending main support member;

a platform member attached to the main support member and extending generally perpendicularly thereto;

a brace member extending at an angle between the main support member and the platform member and connected at each end thereto;

adjustable stop means attached to the platform member for limiting motion of a plank member supported on the platform member;

and a guard rail system removably attached to the scaffold structure;

wherein the platform member includes a tubular, fixed stop attached to a distal end thereof, opposite an end attached to the main support member, and projecting upwardly from the distal end, said guard rail system including a vertically extending guard rail post adjacent the distal end, said guard rail post including a portion thereof inserted within the fixed stop; and wherein the guard rail system further includes a spacing bar connected to the main support member and the guard rail post, and extending substantially horizontally therebetween, the spacing bar further being connected at an intermediate portion thereof to the brace member.

2. The scaffold structure of claim 1, wherein the guard rail post includes a main post member defining a U-shaped channel and a tubular rail support member disposed within the channel, said tubular rail support member including a peg at one end thereof inserted within the fixed stop.

3. The scaffold structure of claim 2, wherein the distal end of the platform member and the fixed stop are disposed within the U-shaped channel.

4. The scaffold structure of claim 2, wherein the rail support member includes a holder on the end opposite the peg for holding a guard rail.

5. The scaffold structure of claim 1, wherein the platform member includes a base wall and side walls orthogonally extending from opposed edges of the base wall to define an elongated channel, said adjustable stop means including a plurality of stop members disposed within the channel, and means for adjustably supporting the stop members in the channel such that the position of the stop members along the channel can be adjusted.

6. The scaffold structure of claim 5, further comprising a plurality of holes formed through the base wall, and each said stop member including a peg extending from a bottom surface thereof and disposed in one of the holes.

7. The scaffold structure of claim 6, wherein the supporting means comprises a rod extending within the channel and supported at its ends by holding means.

8. The scaffold structure of claim 7, wherein each stop member includes a passage through which the rod extends, the passages permitting sliding movement of the stop members along the rod.

9. The scaffold structure of claim 8, wherein each holding means includes a vertically extending slot through which the rod extends, the slots permitting vertical movements of the rod ends.

10. The scaffold structure of claim 9, further comprising a resilient member biasing the rod such that the ends of the rod are normally biased into contact with the bottom of the slots.

11. A scaffold structure, comprising:

a generally vertically extending main support member;

a platform member attached to the main support member and extending generally perpendicularly thereto;

a brace member extending at an angle between the main support member and the platform member and connected at each end thereto;

adjustable stop means attached to the platform member for limiting motion of a plank member supported on the platform member;

and a guard rail system removably attached to the scaffold structure;

wherein the platform member includes a base wall and side walls orthogonally extending from opposed edges of the base wall to define an elongated channel, said adjustable stop means including a plurality of stop members disposed within the channel, and means for adjustable supporting the stop members in the channel such that the position of the stop members along the channel can be adjusted; and a plurality of holes formed through the base wall, and each said stop member including a peg extending from a bottom surface thereof and disposed in one of the holes.

12. The scaffold structure of claim 11, wherein the stop members extend above the level of the side walls.

13. The scaffold structure of claim 11, wherein the supporting means comprises a rod extending within the channel and supported at its ends by holding means.

14. The scaffold structure of claim 13, wherein each stop member includes a passage through which the rod extends, the passages permitting sliding movement of the stop members along the rod.

15. The scaffold structure of claim 14, wherein each holding means includes a vertically extending slot through which the rod extends, the slots permitting vertical movements of the rod ends.

16. The scaffold structure of claim 15, further comprising a resilient member biasing the rod such that the ends of the rod are normally biased into contact with a bottom of the slots.

17. In a scaffold structure of the type having a plurality of generally vertically extending main support members, a plurality of platform members attached to the main support members and extending perpendicularly therefrom, and a plurality of brace members extending at an angle between the main support members and the platform members and connected at each end thereto, the improvement comprising:

adjustable stop means attached to the platform members for limiting motion of a plank member supported on the platform members;

and a guard rail system removably attached to the scaffold structure;

wherein each platform member includes a tubular, fixed stop-attached to a distal end thereof, opposite an end attached to the main support member, and projecting upwardly from the distal end, said guard rail system including a vertically extending guard rail post adjacent each distal end, each said guard rail post including a portion thereof inserted within the fixed stop; and wherein the guard rail system further includes a plurality of spacing bars connected to the main support members and the guard rail posts, and extending substantially horizontally therebetween, each spacing bar further being connected at an intermediate portion thereof to a respective brace member.

18. The scaffold structure of claim 17, wherein each guard rail post includes a main post member defining a U-shaped channel and a tubular rail support member disposed within the channel, said tubular rail support member including a peg at one end thereof inserted within the fixed stop.

19. The scaffold structure of claim 18, wherein the distal end of each platform member and the respective fixed stops are disposed within the U-shaped channels.

20. The scaffold structure of claim 18, wherein each rail support member includes a holder on the end opposite the peg for holding a guard rail.

* * * * *